US008531097B2

(12) United States Patent
Jeong et al.

(10) Patent No.: US 8,531,097 B2
(45) Date of Patent: Sep. 10, 2013

(54) FIELD EMITTER

(75) Inventors: Jin Woo Jeong, Daejeon (KR); Jun Tae Kang, Daegu (KR); Yoon Ho Song, Daejeon (KR); Jae Woo Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 13/481,373

(22) Filed: May 25, 2012

(65) Prior Publication Data

US 2012/0306348 A1 Dec. 6, 2012

(30) Foreign Application Priority Data

May 31, 2011 (KR) ..... 10-2011-0051938

(51) Int. Cl.
*H01J 1/304* (2006.01)

(52) U.S. Cl.
USPC ..... 313/310; 313/495; 313/309; 313/336; 313/351

(58) Field of Classification Search
None
See application file for complete search history.

(56) References Cited

U.S. PATENT DOCUMENTS

| | | | | |
|---|---|---|---|---|
| 5,651,713 | A * | 7/1997 | Lee et al. | 445/50 |
| 2002/0024279 | A1 * | 2/2002 | Simpson et al. | 313/309 |
| 2004/0115870 | A1 * | 6/2004 | Hwang et al. | 438/184 |
| 2005/0057168 | A1 * | 3/2005 | Song et al. | 315/111.81 |
| 2006/0208628 | A1 * | 9/2006 | Lee | 313/497 |
| 2006/0290259 | A1 * | 12/2006 | Song et al. | 313/495 |
| 2007/0114911 | A1 * | 5/2007 | Ryu | 313/495 |
| 2007/0236132 | A1 * | 10/2007 | Lee | 313/496 |

FOREIGN PATENT DOCUMENTS

| | | | |
|---|---|---|---|
| KR | 10-2001-0058197 | A | 7/2001 |
| KR | 10-2006-0001622 | A | 1/2006 |
| KR | 10-2009-0099323 | A | 9/2009 |
| KR | 10-2010-0105084 | A | 9/2010 |
| KR | 10-2010-0123253 | A | 11/2010 |

* cited by examiner

*Primary Examiner* — Ashok Patel
(74) *Attorney, Agent, or Firm* — Rabin & Berdo, P.C.

(57) ABSTRACT

Disclosed is a field emitter, including: a cathode electrode in a shape of a tip; an emitter having a diameter smaller than a diameter of the cathode electrode and formed on the cathode electrode; and a gate electrode having a single hole and located above the emitter while maintaining a predetermined distance from the emitter.

5 Claims, 5 Drawing Sheets

<PRIOR ART>

<PRIOR ART>

<PRIOR ART>

<PRIOR ART>

FIELD EMITTER

CROSS-REFERENCE TO RELATED APPLICATIONS

This application is based on and claims priority from Korean Patent Application No. 10-2011-0051938, filed on May 31, 2011, with the Korean Intellectual Property Office, the present disclosure of which is incorporated herein in its entirety by reference.

TECHNICAL FIELD

The present disclosure relates to a field emitter, and more particularly, to a triode type field emitter using a tip type cathode electrode which can significantly reduce leakage current of a gate electrode.

BACKGROUND

In field emitters using nano materials, carbon nanotubes or carbon nanowires are in the spotlight as electron emitting materials. A carbon nanotube is a structure where a one-dimensional honeycombed plate is wound in a shape of a tube, and shows excellent electrical, mechanical, chemical, and thermal characteristics in applications of various fields. A carbon nanotube having a high aspect ratio can easily emit electrons even in an electric field having a low potential due to its excellent geometric characteristics.

Thus, in recent years, electric field displays and lamps using carbon nanotubes are being widely studied in Korea, and studies on emission of electrons in an infinitesimal area such as a tip of X-ray source devices, atomic force microscopes (AFMs), and scanning electron microscopes (SEMS) are also being activly conducted. A structure where an emitter is formed on a tip type cathode electrode is advantageous in producing carbon natotube (CNT) electron beams having high efficiency and high density such as subminiature devices or micro focusing devices. The emitter on the tip type cathode electrode emits electrons in an infinitesimal area and electric fields are concentrated due to its geometric structure.

FIG. 1 is a view illustrating a field emitter according to the related art.

Referring to FIG. 1, the field emitter according to the related art has a triode structure where an emitter 120 is formed on a tip type cathode electrode 110 and a gate electrode 130 for drawing electrons from the emitter 120 is disposed above the emitter 120.

As illustrated in FIG. 1A, in the triode type field emitter, the gate electrode 130 has a mesh in a form of a net, or as illustrated in FIG. 1B, has a single hole 132 through which electron beams emitted from the emitter 120 can pass.

However, the gate electrode 130 having a mesh can be variously selected according to a thickness of a mesh wire or an opening ratio of the mesh, but cannot prevent leakage of current occurring when electrons emitted from the emitter 120 escape along the mesh. Then, if the leakage current of the gate electrode 130 is high, heat is generated and a possibility of generating an arc between the cathode electrode 110 and the gate electrode 130 increases, reducing stability during electric field emission.

The gate electrode 130 having the hole 132 can reduce leakage currents as a size of the hole 132 increases, but a voltage applied to the gate electrode 130 increases as the size of the hole 132 increases.

SUMMARY

The present disclosure has been made in an effort to provide a field emitter which can drastically lower a leakage current generated when a triode type field emitter using a cathode electrode in a shape of a tip is driven.

An exemplary embodiment of the present disclosure provides a field emitter, including: a cathode electrode in a shape of a tip; an emitter having a diameter smaller than a diameter of the cathode electrode and formed on the cathode electrode; and a gate electrode having a single hole and located above the emitter while maintaining a predetermined distance from the emitter.

As described above, the present disclosure provides a field emitter where an emitter is formed in a region on a cathode electrode to drastically reduce a leakage current generated in a gate electrode and lower a voltage of the gate electrode.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment of the present disclosure will be described in detail with reference to the accompanying drawings. In the description of the present disclosure, a detailed description of known configurations and functions may be omitted to avoid obscure understanding of the present disclosure.

Figure 1:
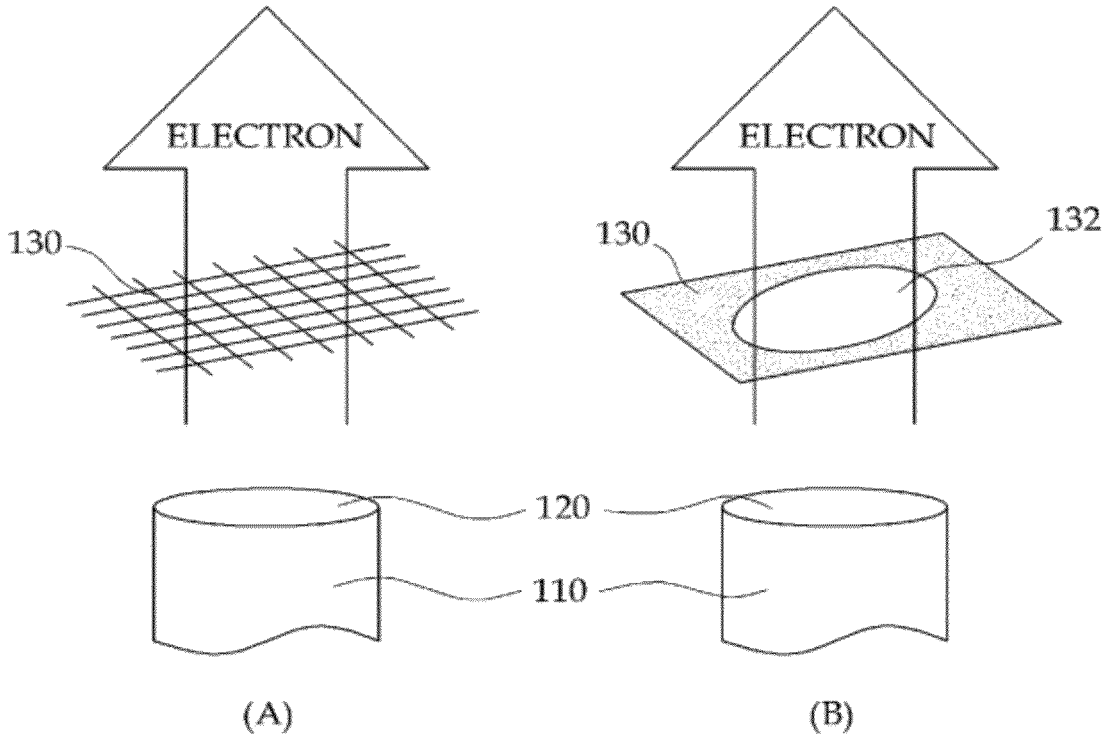
FIG. 1 is a view illustrating a configuration of a field emitter according to the related art.
Figure 2:
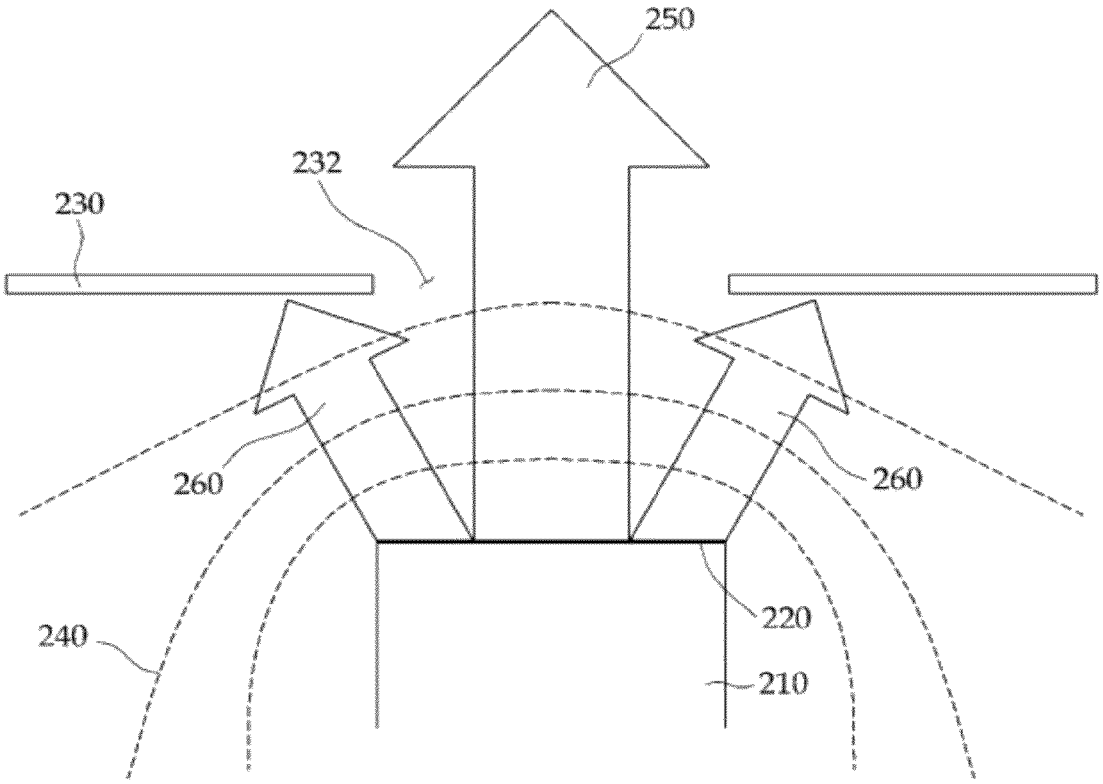
FIG. 2 is a view for explaining a cause of leakage of current to a gate electrode in the field emitter according to the related art.

FIG. 2 is a view for explaining a cause of leakage of current to a gate electrode in a field emitter according to the related art.

Referring to FIG. 2, the triode type field emitter according to the related art includes a gate electrode 230 having a single hole 232, and electrons 250 and 260 emitted from an emitter 220 on a cathode electrode 210 in a shape of a tip are leaked to the gate electrode 230 due to equipotential lines curved according to a geometric shape of the tip type cathode electrode 210.

That is, since the electrons 250 and 260 are moved by force of electric fields and the electric fields are perpendicular to the equipotential line 240, the electrons 250 and 260 are moved by force in a direction perpendicular to the equipotential line 240.

As illustrated in FIG. 2, the equipotential line 240 around the cathode electrode 210 is curved due to a sharp shape of the tip type cathode electrode 210, such that the electron 260 emitted from the emitter 220 located at a periphery of the cathode electrode 210 fails to directly proceed toward the hole 232 of the gate electrode 230 due to the influence of the curved equipotential line 240, causing the electrons to be deflected outward, resulting in leakage of currents.

Figure 3:
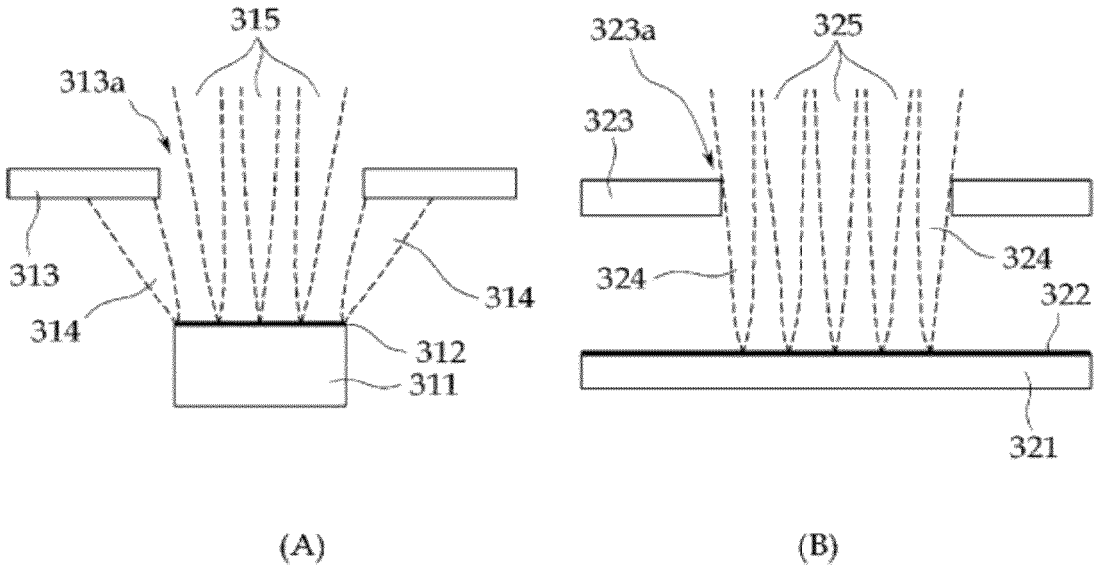
FIG. 3 illustrates views of simulations of loci of electrons emitted from emitters in the field emitter according to the related art.

FIG. 3 illustrates views of simulations of loci of electrons emitted from emitters in the field emitter according to the related art.

Referring to FIG. 3A, it can be seen that unlike an emitter 322 formed on a planar cathode electrode 321 of FIG. 3B, when it comes to an emitter 312 formed on a tip type cathode electrode 311, electron beams 314 generated at peripheries of the emitter 312 fail to be drawn toward a hole 313*a* of the gate electrode 313 but are deflected to the outside of the hole 313*a*.

That is, as illustrated in FIG. 3A, it can be seen that loci of electron beams 314 generated at opposite peripheries of the emitter 312 are severely distorted, but electron beams emitted from a central portion of the emitter 312 pass the hole 313*a* relatively smoothly.

Thus, in the exemplary embodiment of the present disclosure, an emitter on a tip type cathode electrode is formed only in a region where electron beams are not deflected so that leakage of current can be reduced while achieving an advantage of the emitter formed on the tip type cathode electrode.

Figure 4:
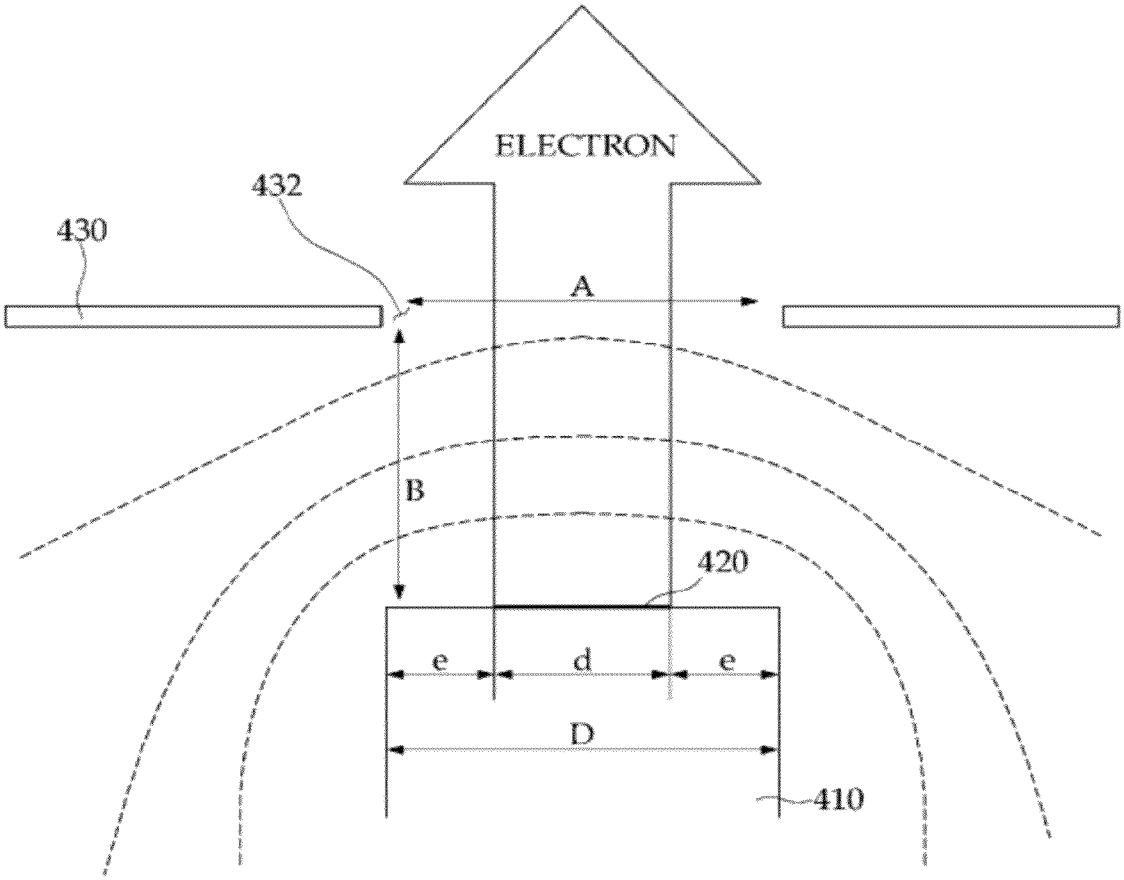
FIG. 4 is a view illustrating a configuration of a field emitter according to an exemplary embodiment of the present disclosure.

FIG. 4 is a view illustrating a configuration of a field emitter according to an exemplary embodiment of the present disclosure.

Referring to FIG. 4, the field emitter according to the present disclosure includes a tip type cathode electrode 410, an emitter 420 formed in a region on the cathode electrode 410, and a gate electrode 430 having a single hole 432 and located above the emitter 420 while maintaining a predetermined distance B from the emitter 420.

The emitter 420 has a diameter d smaller than a diameter D of the cathode electrode 410 and maintains a predetermined distance e between a periphery of the cathode electrode 410 and an end of the emitter 420, restraining the current from being leaked to the gate electrode 430. Then, the diameter d of the emitter 420 may be varied according to the diameter D of the cathode electrode 410, a diameter A of the hole 432 of the gate electrode 430, and a distance B between the cathode electrode 410 and the gate electrode 430.

The diameter d of the emitter 420 is smaller than the diameter D of the cathode electrode 410, and a minimum diameter of the emitter 420 may be determined according to an area for withdrawing desired currents.

The diameter A of the hole 432 of the gate electrode 430 may be larger than the diameter d of the emitter 420 and smaller than 10 times of the diameter D of the cathode electrode 410.

The distance B between the cathode electrode 410 and the gate electrode 430 may be larger than 0 and smaller than 10 times of the diameter D of the cathode electrode 410.

Figure 5:
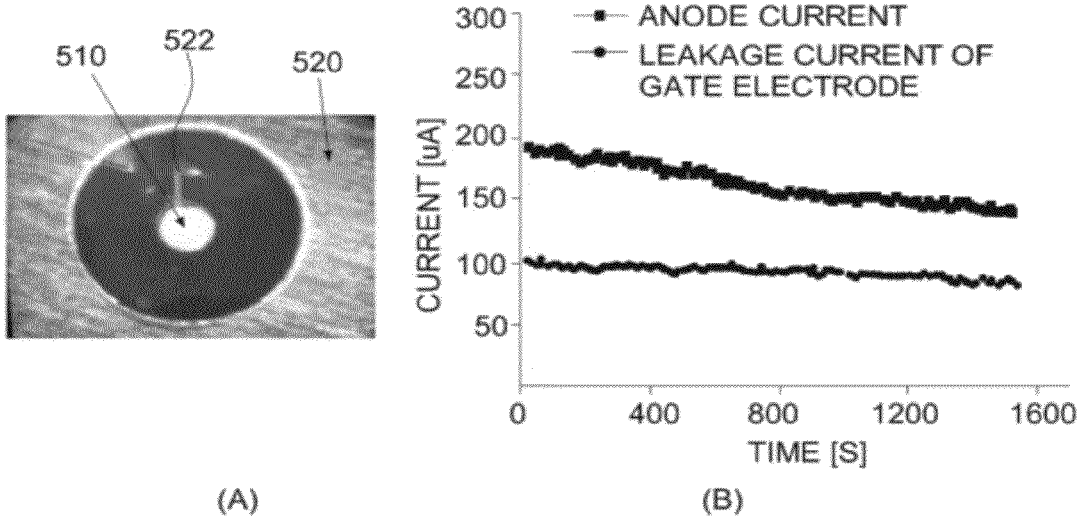
FIG. 5 illustrates a plan view of the field emitter according to the related art and a graph representing an experimental result of electric field emissions.

FIG. 5 illustrates a plan view of the field emitter according to the related art and a graph representing an experimental result of electric field emissions.

Referring to FIG. 5A, in the field emitter used in the experiment, an emitter 510 is formed on a cathode electrode having a diameter of 500 μm, and a gate electrode 520 having a hole of 2 mm and an anode electrode (not shown) are spaced apart from each other by a distance of 5 mm.

Referring to FIG. 5B, an anode current is approximately 200 μA at an anode voltage of 3 kV and a gate voltage of 2 kV, that is, a leakage current of the gate electrode 520 is approximately 100 μV. Thus, a leakage current of the gate electrode with respect to an anode current is approximately 50%.

Figure 6:
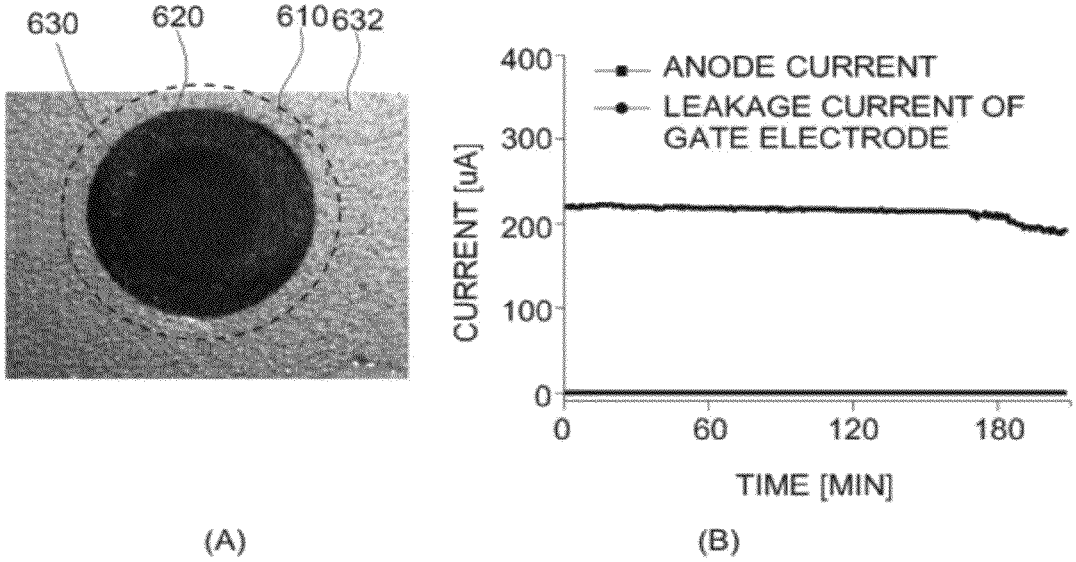
FIG. 6 illustrates a plan view of the field emitter according to the present disclosure and a graph representing an experimental result of electric field emissions.

FIG. 6 illustrates a plan view of the field emitter according to the present disclosure and a graph representing an experimental result of electric field emissions.

Referring to FIG. 6A, in the field emitter used in the experiment to which a size of the field emitter is applied according to the present disclosure, a diameter of a tip type cathode electrode 610 is approximately 2 mm, a diameter of an emitter 620 formed on the cathode electrode 610 is 650 μm, and a diameter of a hole 630 of a gate electrode 632 is 1 mm.

Referring to FIG. 6B, it can be seen that when an anode current of approximately 200 μA is emitted at an anode voltage of 3 kV and a gate voltage of 1.4 kV, a leakage current of the gate electrode is rarely generated.

Thus, when compared with the experimental result of FIG. 5, it can be seen that the field emitter according to the present disclosure can phenomenally reduce leakage current and lower a gate voltage.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A field emitter, comprising:

a cathode electrode in a shape of a tip;

an emitter having a diameter smaller than a diameter of the cathode electrode, having a shape of a plate, and formed on the cathode electrode; and a gate electrode having a single hole and located above the emitter while maintaining a predetermined distance from the emitter.

2. The field emitter of claim 1, wherein the diameter of the emitter is varied according to the diameter of the cathode electrode, a diameter of the hole of the gate electrode, and a distance between the cathode electrode and the gate electrode.

3. The field emitter of claim 1, wherein the diameter of the emitter is smaller than the diameter of the cathode electrode, and a minimum diameter of the emitter is determined according to an area for withdrawing a desired current.

4. The field emitter of claim 1, wherein the diameter of the hole of the gate electrode is larger than the diameter of the emitter and smaller than 10 times of the diameter of the cathode electrode.

5. The field emitter of claim 1, wherein a distance between the cathode electrode and the gate electrode is larger than 0 and smaller than 10 times of the diameter of the cathode electrode.

* * * * *